US006435926B1

(12) United States Patent
Yeh

(10) Patent No.: US 6,435,926 B1
(45) **Date of Patent: *Aug. 20, 2002**

(54) ADJUSTING STRAP STRUCTURE FOR SWIM FINS

(76) Inventor: Taong In Yeh, 1 Fl., No. 5-1 Ho Tso Street, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 09/717,246

(22) Filed: Nov. 22, 2000

Related U.S. Application Data

(63) Continuation-in-part of application No. 09/542,829, filed on Apr. 4, 2000, now Pat. No. 6,247,983.

(51) Int. Cl.[7] ..... A63B 31/08
(52) U.S. Cl. ..... 441/64
(58) Field of Search ..... 441/64; 36/11.5

(56) References Cited

U.S. PATENT DOCUMENTS 4,832,644 A * 5/1989 Roberts ..... 441/64
5,423,134 A * 6/1995 Bagnaia et al. ..... 36/11.5
6,052,920 A * 4/2000 Bathum ..... 36/11.5
6,212,798 B1 * 4/2001 Koenig et al. ..... 36/110
6,247,983 B1 * 6/2001 Yeh ..... 441/64
6,309,270 B1 * 10/2001 Harwell, IV et al. ..... 441/55

* cited by examiner

*Primary Examiner*—S. Joseph Morano
*Assistant Examiner*—Andrew Wright

(57) ABSTRACT

An adjusting strap structure provided for a pair of swim fins each of which includes a foot pocket having two side walls each defining a first hole and a second hole. The adjusting strap structure includes an adjusting strap having two opposite sides and two distal ends, two first snapping members each mounted on the respective distal end of a first side of the adjusting strap, and a second snapping member mounted on the first side of the adjusting strap for detachably engaging with the two first snapping members. In such a manner, each distal end of the adjusting strap extends through a respective side wall of the foot pocket, and each first snapping member is detachably engaged with the second snapping member. In addition, each distal end of the adjusting strap in turn passes through the foot pocket into the second hole to extend outward from the second hole, and then passes through the first hole into the foot pocket to extend outward from the foot pocket.

10 Claims, 6 Drawing Sheets

ADJUSTING STRAP STRUCTURE FOR SWIM FINS

CROSS-REFERENCES TO RELATED APPLICATIONS

The present invention is a continuation-in-part application of the U.S. Ser. No. 09/542,829, filed on Apr. 4, 2000, now 6,747,983.

BACKGROUND OF THE INVENTION

1. Field of the Invention

The present invention relates to an adjusting strap structure, and more particularly to an adjusting strap structure for a pair of swim fins.

2. Description of the Related Art

The closest prior arts of which the applicant is aware are disclosed as follows.

1. U.S. Pat. No. 5,183,424 to Field.
2. U.S. Pat. No. 5,423,134 to Bagnaia et al.
3. U.S. Pat. No. 4,832,644 to Roberts.
4. U.S. Pat. No. 4,795,385 to Matsuoka.
5. U.S. Pat. No. D332,516 to Middleton.

In the Field reference, it disclosed a flipper 10 includes a heel strap 50 provided with a loop tape 70 and having a static end 52 fixed to one side of the shoe portion 12, and a free end 60 provided with a hook tape 68. The free end 60 is threaded through a buckle 62 and folded back so that the hook tape 68 engages with the loop tape 70 to hold the free end 60 in place against the midpoint of the heel strap 50. However, a gap is formed between the hook tape 68 and the loop tape 70 due to existence of the buckle 62 so that the hook tape 68 cannot tightly engage with the loop tape 70, thereby decreasing the bonding effect between the loop tape 70 and the hook tape 68.

SUMMARY OF THE INVENTION

In accordance with one aspect of the present invention, there is provided a adjusting strap structure in combination with one of a pair of swim fins, the one swim fin including a foot pocket having two side walls each defining a first hole and a second hole spaced from each other, and the adjusting strap structure comprising:

an elongated adjusting strap including two opposite sides and having two distal ends;

two first snapping members each mounted on each of the two distal ends of a first side of the adjusting strap; and at least one second snapping member mounted on the first side of the adjusting strap and located between the two first snapping members for detachably engaging with the two first snapping members;

wherein, each of the two distal ends of the adjusting strap extends through a respective side wall of the foot pocket, and each of the two first snapping members are detachably engaged with the at least one second snapping member; and wherein, each of the two distal ends of the adjusting strap in turn passes through the foot pocket into the second hole to extend outward from the second hole, and then passes through the first hole into the foot pocket to extend outward from the foot pocket.

In accordance with a first embodiment of the present invention, the adjusting strap structure comprises a second snapping member mounted on a mediate portion of the first side of the adjusting strap and located between the two first snapping members.

In accordance with a second embodiment of the present invention, the adjusting strap structure comprises two second snapping members each mounted on the first side of the adjusting strap and located adjacent to a respective first snapping member.

Further benefits and advantages of the present invention will become apparent after a careful reading of the detailed description with appropriate reference to the accompanying drawings.

DETAILED DESCRIPTION OF THE INVENTION

Figure 1:
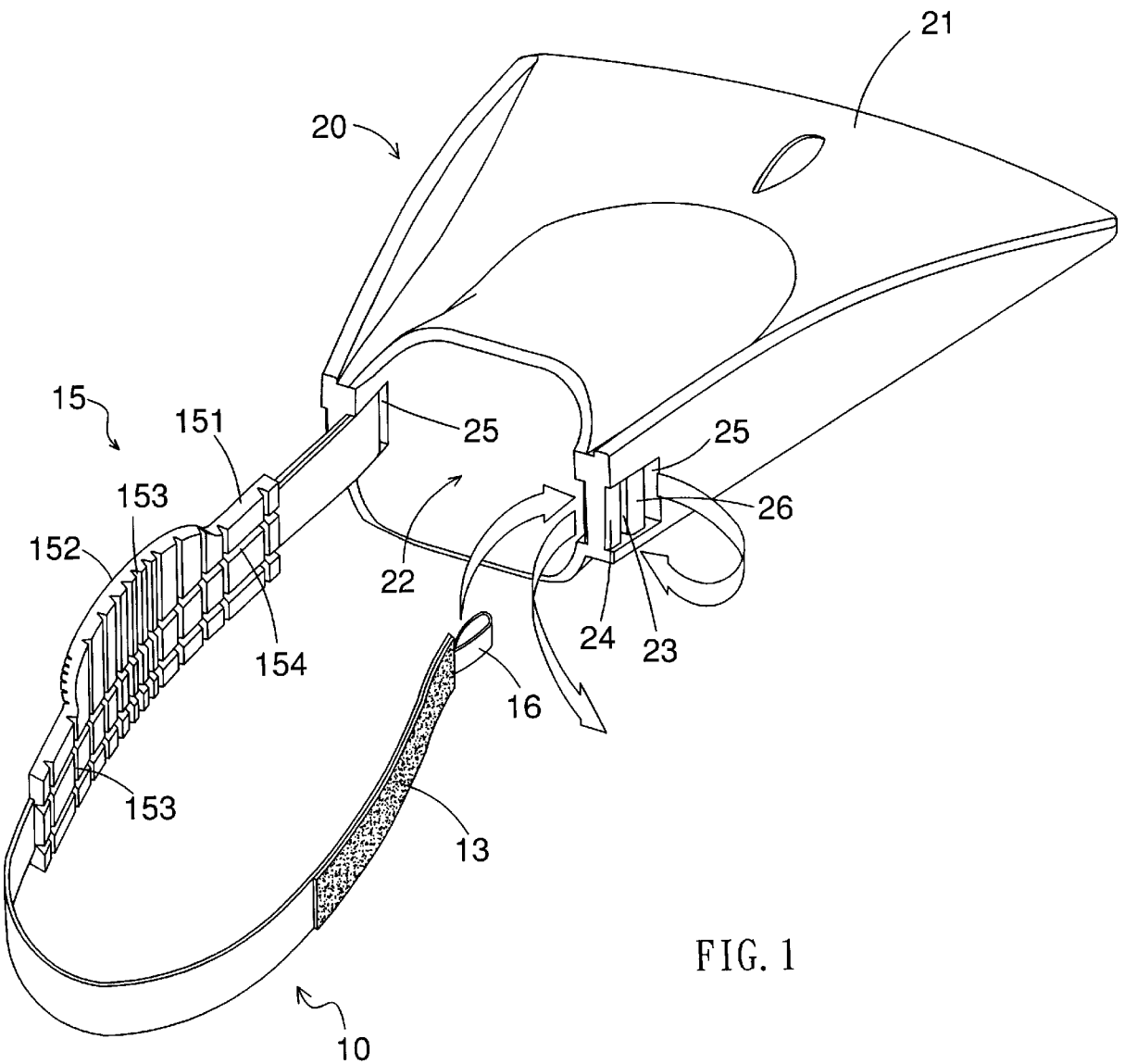
FIG. 1 is a perspective view of an adjusting strap structure for a pair of swim fins in accordance with a first embodiment of the present invention.
Figure 2:
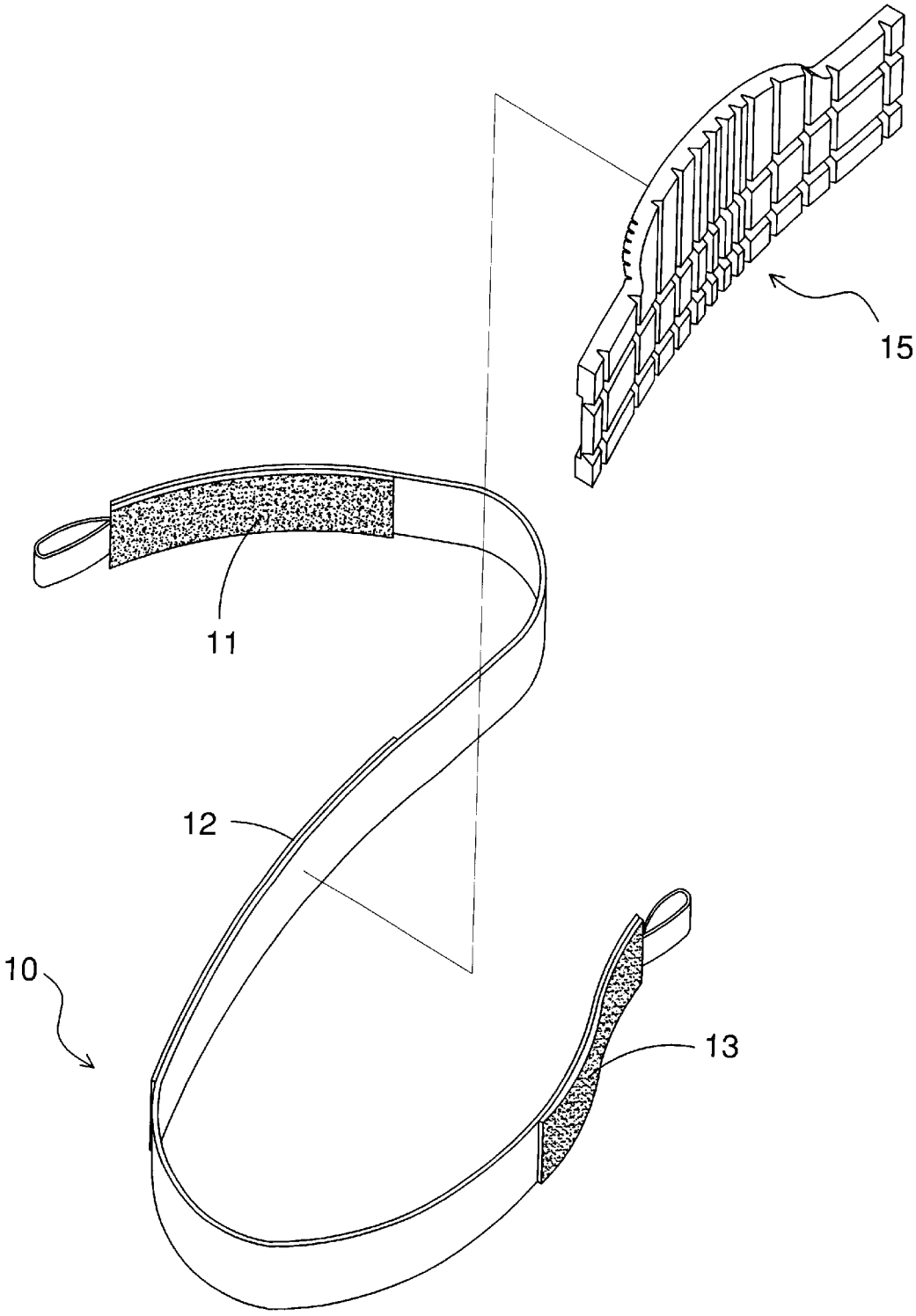
FIG. 2 is an exploded view of the adjusting strap structure for a pair of swim fins as shown in FIG. 1.

Referring to the drawings and initially to FIGS. 1–4, an adjusting strap structure in accordance with a first embodiment of the present invention is used for one of a pair of swim fins 20. Each of the pair of swim fins 20 includes a blade 21, and a foot pocket 22. The foot pocket 22 has two side walls each defining a first hole 23 and a second hole 25 spaced from each other. Each of the two side walls of the foot pocket 22 is provided with a first support axle 24 located beside the first hole 23, and a second support axle 26 located between the first hole 23 and the second hole 25.

The adjusting strap structure comprises an elongated adjusting strap 10 made of a knitted fiber including two opposite sides and having two distal ends, two first snapping members 11 and 13 each mounted on each of the two distal ends of a first side of the adjusting strap 10, and a second snapping member 12 mounted on the mediate portion of the first side of the adjusting strap 10 and located between the two first snapping members 11 and 13 for detachably engaging with the two first snapping members 11 and 13. Each of the two distal ends of the adjusting strap 10 is provided with a pull tab 16. The snapping members 11, 12 and 13 are preferably made of hook/loop shaped elements (the so called "Velcro" strips) so that they can be detachably snapped with each other.

In such a manner, each of the two distal ends of the adjusting strap 10 may be extended through a respective side wall of the foot pocket 22 so that each of the two first snapping members 11 and 13 is detachably engaged with the second snapping member 12.

Figure 3:
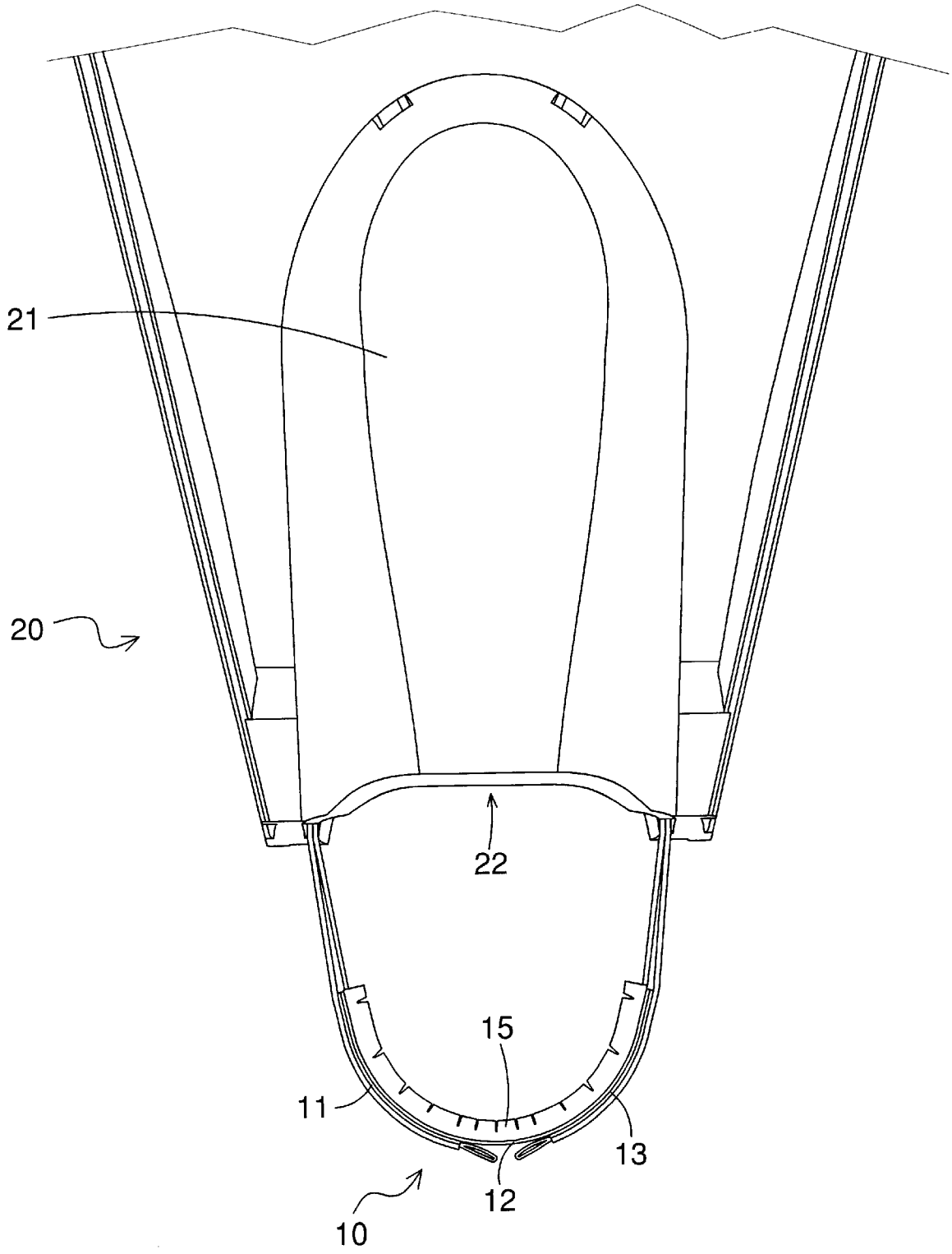
FIG. 3 is a top plan assembly view of the adjusting strap structure for a pair of swim fins as shown in FIG. 1.
Figure 4:
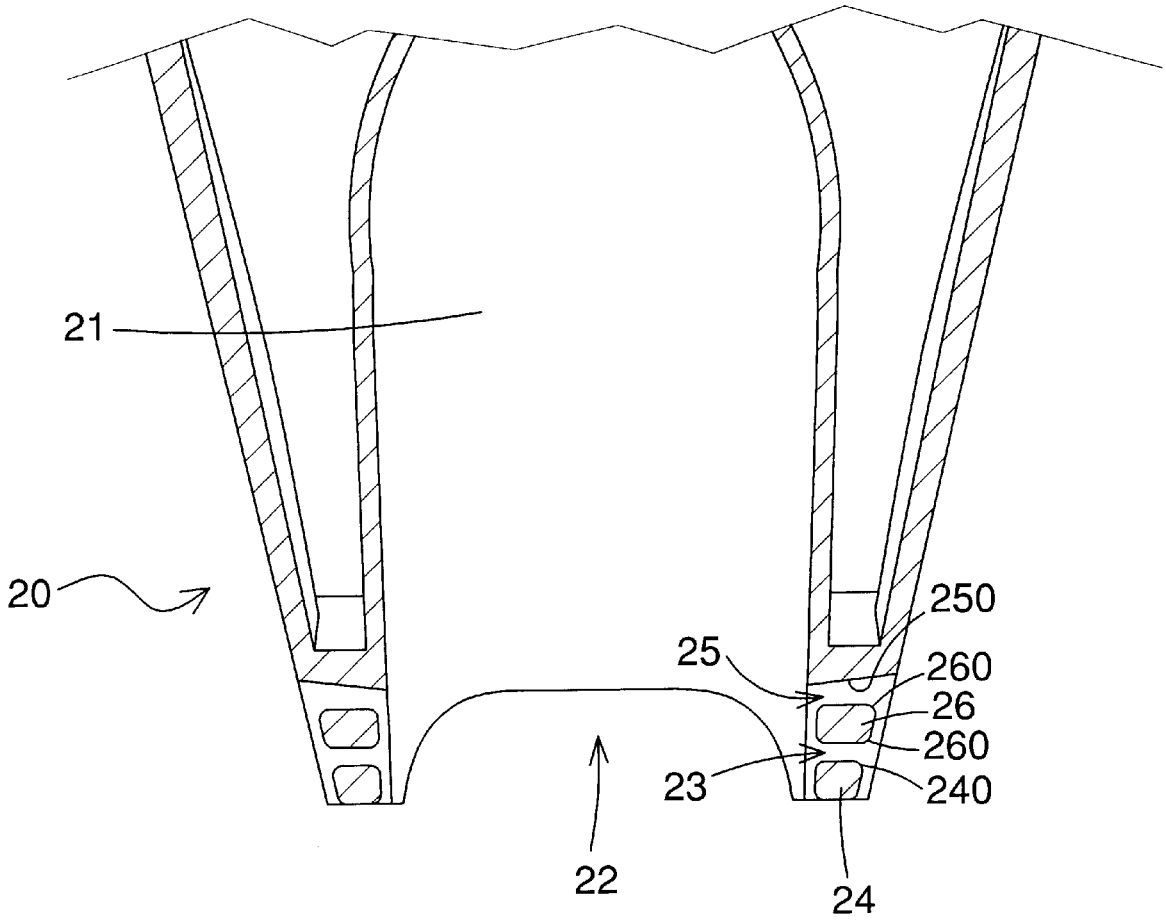
FIG. 4 is a top plan partially cross-sectional view of the foot pocket of the swim fins as shown in FIG. 1.

In practice, as indicated by arrows shown in FIG. 1, each of the two distal ends of the adjusting strap 10 in turn passes through the foot pocket 22 into the second hole 25 to extend outward from the second hole 25, and then passes through the first hole 23 into the foot pocket 22 to extend outward from the foot pocket 22 so that each of the two first snapping members 11 and 13 can be engaged on the second snapping member 12, thereby securing the adjusting strap 10 to the foot pocket 22 of the swim fin 20 as shown in FIG. 3.

It is appreciated that, each of the two distal ends of the adjusting strap 10 is limited by the first support axle 24 and the second support axle 26 after it is passed through the first hole 23 so that each of the first snapping members 11 and 13 can be tightly engaged with the second snapping member 12 without incurring a gap formed therebetween, thereby greatly enhancing the bonding effect between the first snapping members 11 and 13 and the second snapping member 12.

The relative snapping position between each of the first snapping members 11 and 13 and the second snapping member 12 can be changed and adjusted so that the length of the adjusting strap 10 relative to the foot pocket 22 can be arbitrarily varied, thereby facilitating the wearer adjusting the tension and relaxation of the adjusting strap 10 relative to the user's feet so that the adjusting strap 10 can be used to fit users of different statures, thereby greatly enhancing the versatility of the adjusting strap 10.

Preferably, the second hole 25 of the foot pocket 22 is provided with an inclined surface 250 for facilitating passage of each of the two distal ends of the adjusting strap 10. Preferably, the first support axle 24 has an arcuate end face 240 facing the first hole 23 for facilitating passage of each of the two distal ends of the adjusting strap 10. Preferably, the second support axle 26 has two sides each provided with an arcuate surface 260 for facilitating passage of each of the two distal ends of the adjusting strap 10.

The adjusting strap structure further comprises a flexible foam pad 15 secured on the mediate portion of the adjusting strap 10 and facing the foot pocket 22 for providing a cushioning effect and causing a comfortable sensation to the wearer. The flexible pad 15 includes an elongated body 151 defining a plurality of V-shaped lengthwise grooves 153 and a plurality of crosswise slits 154 intersecting the lengthwise grooves 153, and a protrusion 152 protruding upward from the mediate portion of the elongated body 151 and defining a plurality of V-shaped crosswise grooves 156. The lengthwise grooves 153 can be used for increasing the flexibility of the flexible pad 15 so as to fit the horizontal curvature of the user's heel, and the crosswise grooves 156 can also be used for increasing the flexibility of the flexible pad 15 so as to fit the vertical curvature of the user's heel.

Figure 5:
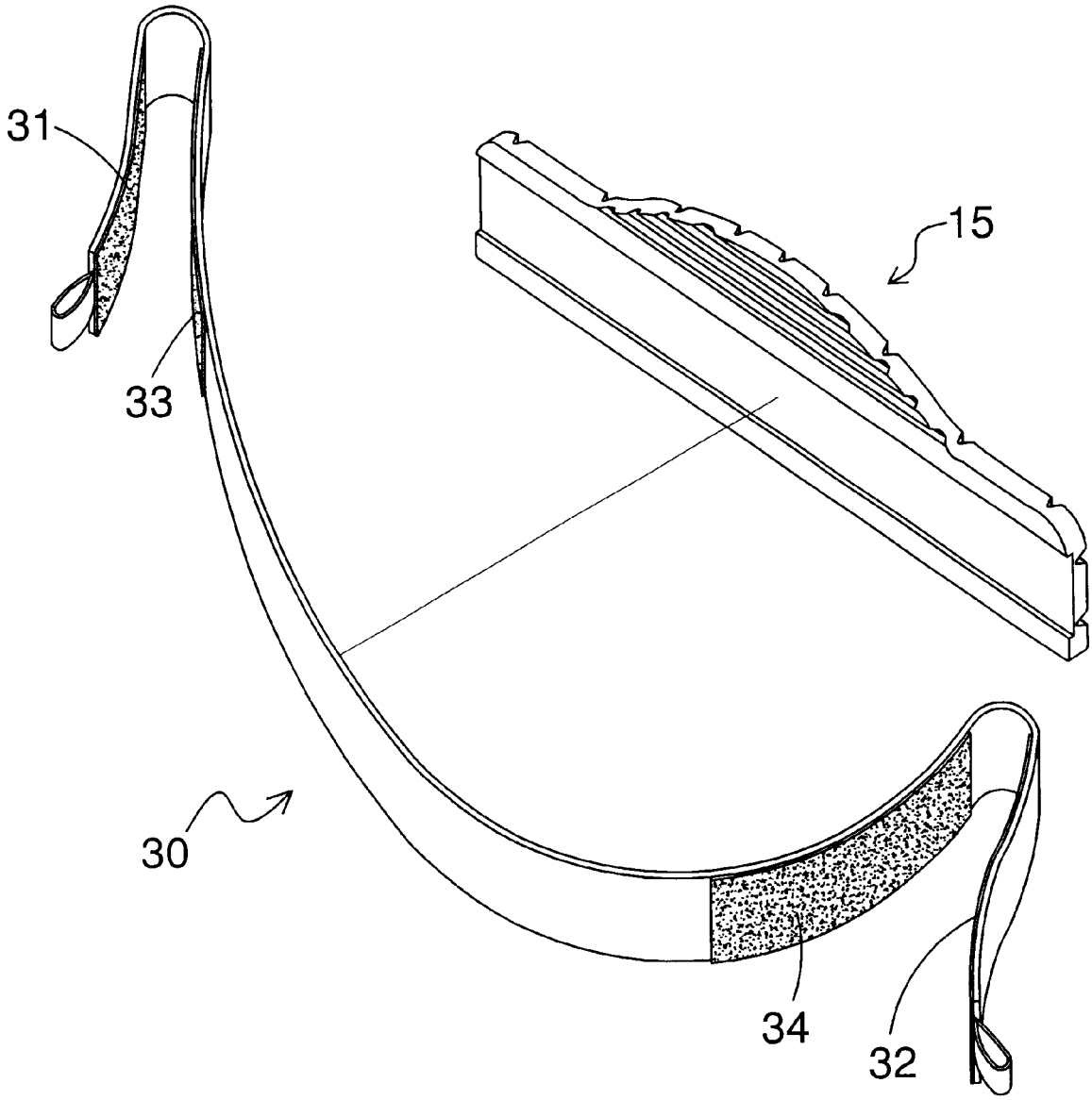
FIG. 5 is an exploded view of an adjusting strap structure for a pair of swim fins in accordance with a second embodiment of the present invention.
Figure 6:
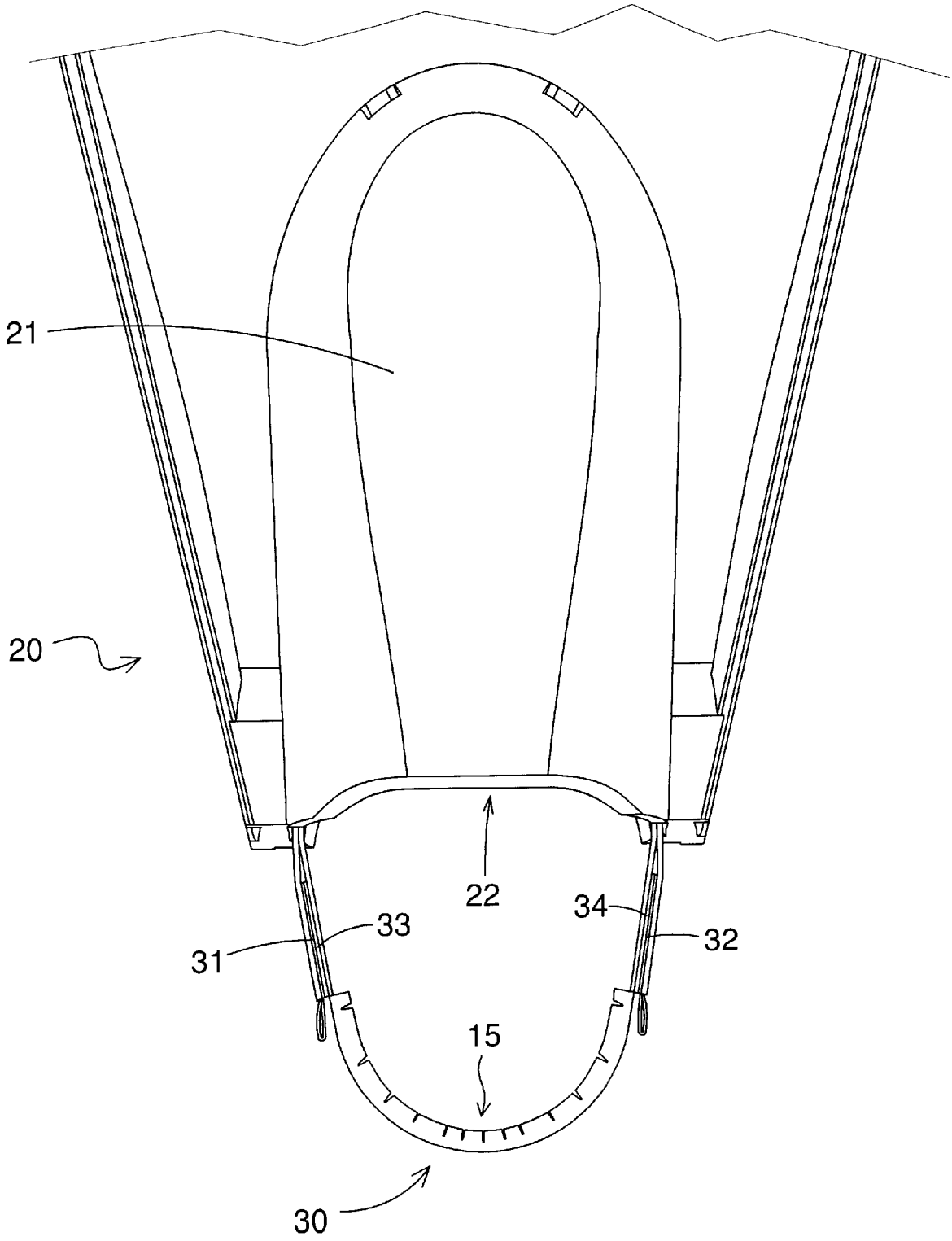
FIG. 6 is a top plan assembly view of the adjusting strap structure for a pair of swim fins as shown in FIG. 5.

Referring to FIGS. 5 and 6, in accordance with a second embodiment of the present invention, the adjusting strap structure 30 comprises two second snapping members 33 and 34 each mounted on the first side of the adjusting strap 10 and located adjacent to a respective first snapping member 31 and 32.

Accordingly, the adjusting strap structure in accordance with the present invention can be used to conveniently and quickly adjust the length, the tension and the relaxation of the adjusting strap relative to the foot pocket of the swim fin so as to fit users of different statures, thereby increasing the versatility of the adjusting strap structure. In addition, the flexible pad can be used to protect the user's feet without the possibility of injuring the user when wearing the adjusting strap.

It should be clear to those skilled in the art that further embodiments may be made without departing from the scope of the present invention.

What is claimed is:

1. An adjusting strap structure in combination with one of a pair of swim fins, said one swim fin including a foot pocket (22) having two side walls each defining a first hole (23) and a second hole (25) spaced from each other, and said adjusting strap structure comprising:

an elongated adjusting strap including two opposite sides and having two distal ends;

two first snapping members each mounted on each of said two distal ends of a first side of said adjusting strap; and at least one second snapping member mounted on said first side of said adjusting strap and located between said two first snapping members for detachably engaging with said two first snapping members;

wherein, each of said two distal ends of said adjusting strap extends through a respective side wall of said foot pocket (22), and each of said two first snapping members is detachably engaged with said at least one second snapping member; and wherein, each of said two distal ends of said adjusting strap in turn passes through said foot pocket (22) into said second hole (25) to extend outward from said second hole (25), and then passes through said first hole (23) into said foot pocket (22) to extend outward from said foot pocket (22).

2. The adjusting strap structure in combination with one of a pair of swim fins in accordance with claim 1, wherein said second hole (25) of said foot pocket (22) is provided with an inclined surface (250) for facilitating passage of each of said two distal ends of said adjusting strap.

3. The adjusting strap structure in combination with one of a pair of swim fins in accordance with claim 1, wherein each of said two side walls of said foot pocket (22) is provided with a first support axle (24) located beside said first hole (23), and a second support axle (26) located between said first hole (23) and said second hole (25).

4. The adjusting strap structure in combination with one of a pair of swim fins in accordance with claim 3, wherein said first support axle (24) has an arcuate end face (240) facing said first hole (23) for facilitating passage of each of said two distal ends of said adjusting strap.

5. The adjusting strap structure in combination with one of a pair of swim fins in accordance with claim 3, wherein said second support axle (26) has two sides each provided with an arcuate surface (260) for facilitating passage of each of said two distal ends of said adjusting strap.

6. The adjusting strap structure in combination with one of a pair of swim fins in accordance with claim 1, wherein each of said two distal ends of said adjusting strap includes a pull tab (16) mounted thereon.

7. The adjusting strap structure in combination with one of a pair of swim fins in accordance with claim 1, wherein said adjusting strap structure comprises a second snapping member mounted on a mediate portion of said first side of said adjusting strap and located between said two first snapping members.

8. The adjusting strap structure in combination with one of a pair of swim fins in accordance with claim 1, wherein said adjusting strap structure comprises two second snapping members each mounted on said first side of said adjusting strap and located adjacent to a respective first snapping member.

9. The adjusting strap structure in combination with one of a pair of swim fins in accordance with claim 1, further comprising a flexible pad (15) secured on a mediate portion of said adjusting strap and facing said foot pocket (22), wherein said flexible pad (15) includes an elongated body (151) defining a plurality of lengthwise grooves (153) and a plurality of crosswise slits (154) intersecting said lengthwise grooves (153).

10. The adjusting strap structure in combination with one of a pair of swim fins in accordance with claim 9, wherein said flexible pad (15) further includes a protrusion (152) protruding outward from a mediate portion of said elongated body (151) and defining a plurality of crosswise grooves (156).

* * * * *